US007837463B2

(12) United States Patent
Kaupert et al.

(10) Patent No.: US 7,837,463 B2
(45) Date of Patent: Nov. 23, 2010

(54) WALL STRUCTURE FOR A BURNER

(75) Inventors: Andreas Kaupert, Esslingen (DE); Markus Muenzer, Ebersbach (DE); Karl-Heinz Sachs, Freiberg (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 1056 days.

(21) Appl. No.: 11/473,911

(22) Filed: Jun. 23, 2006

(65) Prior Publication Data

US 2007/0003896 A1 Jan. 4, 2007

(30) Foreign Application Priority Data

Jul. 1, 2005 (DE) ..... 10 2005 031 231

(51) Int. Cl.
*F23D 14/12* (2006.01)

(52) U.S. Cl. ..... 431/350; 431/328; 431/326

(58) Field of Classification Search ..... 431/350, 431/328, 354, 326
See application file for complete search history.

(56) References Cited

U.S. PATENT DOCUMENTS 5,237,914 A * 8/1993 Carstensen ..... 99/445
7,611,351 B2 * 11/2009 Krauklis et al. ..... 431/328

* cited by examiner

*Primary Examiner*—Alfred Basichas
(74) *Attorney, Agent, or Firm*—Howard IP Law Group, PC

(57) ABSTRACT

A wall structure for bordering a combustion chamber of a burner has a top plate that is exposed to the combustion chamber and a bottom plate in contact with the top plate in contact zones on a side facing away from the combustion chamber. The top plate and/or the bottom plate are shaped so that a channel system is created between the top plate and the bottom plate. The top plate contains first openings which communicate with the channel system. In addition, the top plate and the bottom plate have joint second openings in the contact zones communicating with a feed space which is arranged on a side of the bottom plate facing away from the combustion chamber.

22 Claims, 5 Drawing Sheets

WALL STRUCTURE FOR A BURNER

FIELD OF THE INVENTION

The present invention relates to a wall structure for bordering a combustion chamber of a burner. The present invention also relates to a burner equipped with such a wall structure.

SUMMARY OF THE INVENTION

With the help of such a burner, a gaseous oxidizer is burned with a gaseous fuel in a combustion reaction that takes place in the combustion chamber. Such a burner may be used, for example, in a fuel cell for burning a hydrogen-product gas mixture at the anode and an oxygen-product gas mixture at the cathode to reduce unwanted hydrogen emissions by the fuel cell. Such a burner is known, for example, from German Patent DE 10 2004 033 545.1 of Jul. 9, 2004, the contents of which are hereby incorporated herein by reference.

It is essential for such a burner that the oxidizer gas and the fuel gas must be added separately to the combustion chamber in order for the highly reactive gases to be able to react with one another only in the combustion chamber. To this end, a wall structure of the burner which borders the combustion chamber on at least one side has first openings for supplying one gas and second openings separate from the former for supplying the second gas.

The present invention is concerned with the problem of providing an improved embodiment for a wall structure and/or a burner of the type defined in the preamble, which is characterized in particular by ease of manufacturing.

The present invention is based on the general idea of shaping a top plate and a bottom plate to form the wall structure and mounting them together so that a channel system is formed between the plates. The top plate facing the combustion chamber then contains first openings that communicate with the channel system. In addition, in contact zones where the two plates are in contact, the top plate has second openings which also pass through the bottom plate and communicate with a feed space that is separate from the channel system. In this way, with a simple and inexpensive structure two separate gas paths are implemented in the wall structure, opening into the combustion chamber through separate openings in the top plate.

In another embodiment, the wall structure may have an enclosure at the side which encloses the feed space and the channel system and in particular the panels on the sides. Due to this enclosure, it is possible to seal the channel system and the feed system. The wall structure forms a completely prefabricated module with the enclosure, which simplifies assembly of the burner equipped with this wall structure. The enclosure may be equipped with a first feed pipe which communicates with the channel system. Likewise the second feed pipe may be provided, communicating with the feed space.

The wall structure can be manufactured especially advantageously by first providing the top plate with the first openings and then joining it to the bottom plate to form the channel system. A soldered joint, for example, is suitable for this purpose. Then the second holes are formed. Next, the feed pipes can be mounted on the enclosure, e.g., again by means of soldered joint. A soldered joint with a reduced soldering temperature is preferably used so as not to endanger the soldered joint between the top plate and the bottom plate when soldering.

BRIEF DESCRIPTION OF THE DRAWINGS

Other features and advantages of the present invention are derived from the Claims, the drawings and the respective description of the figures on the basis of the drawings.

It is self-evident that the features mentioned above and those to be explained below may be used not only in the particular combination given but also in other combinations or alone without going beyond the scope of the present invention.

Figure 1:
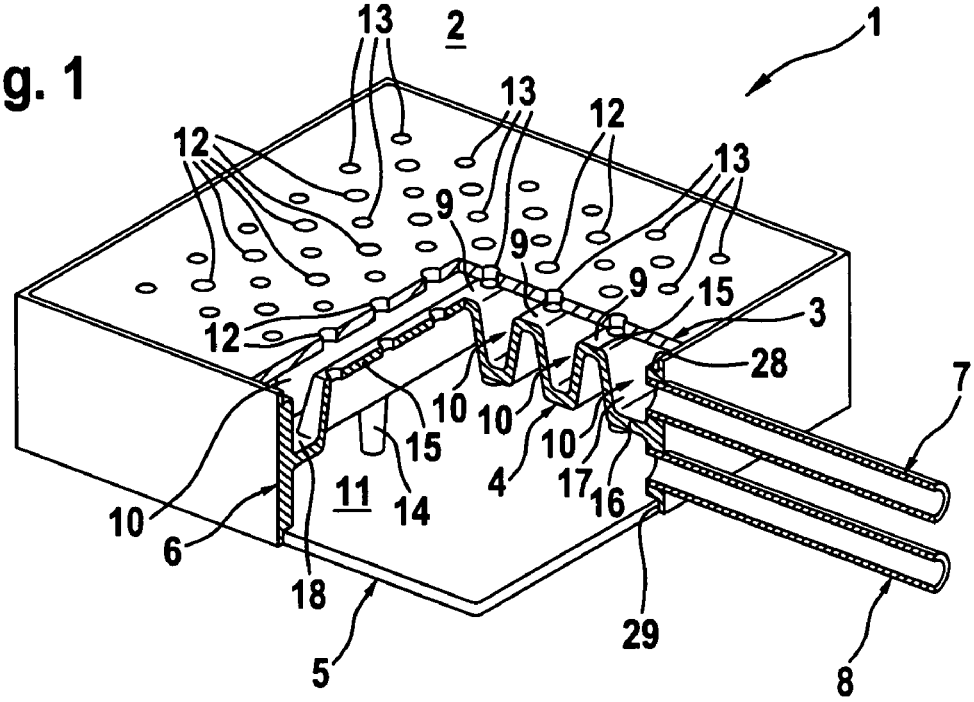

Preferred exemplary embodiments of the present invention are depicted in the drawings and explained in greater detail in the following description, where the same reference notation is used to refer to the same or similar or functionally similar components.

Figure 2:
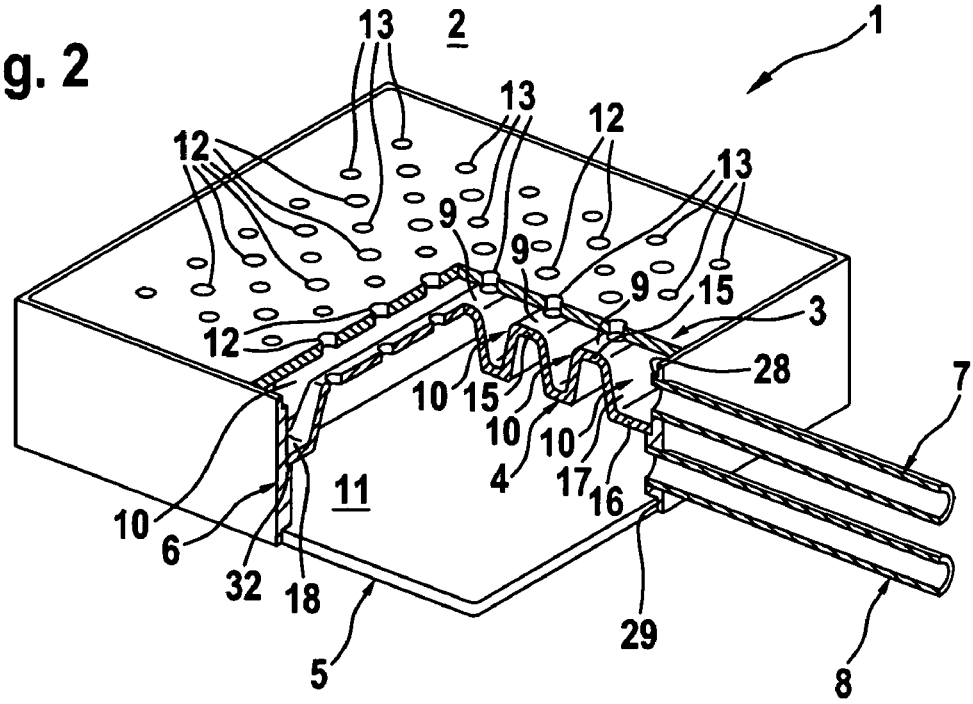
Figure 3:
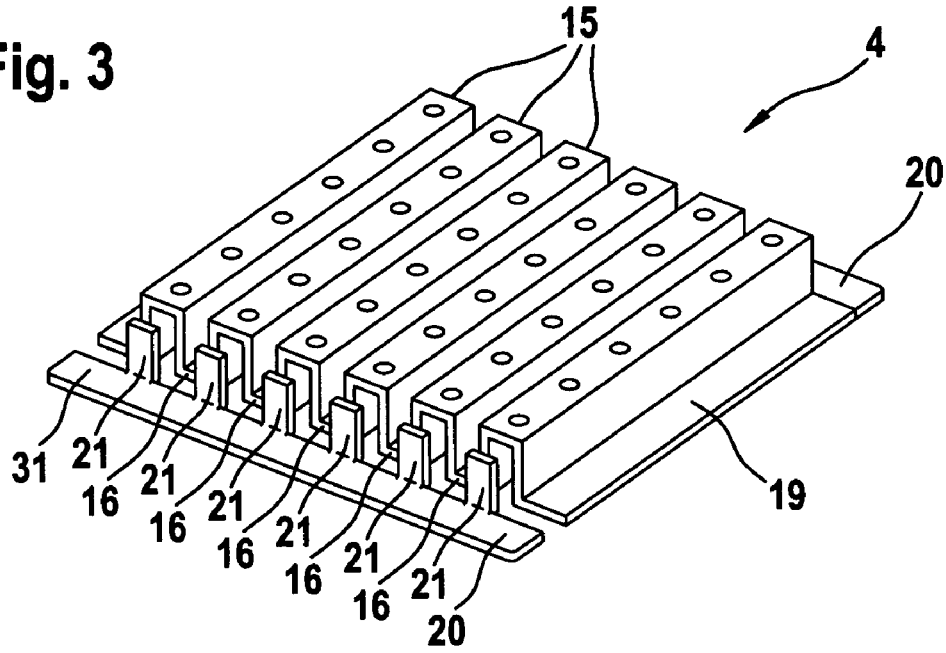
Figure 4:
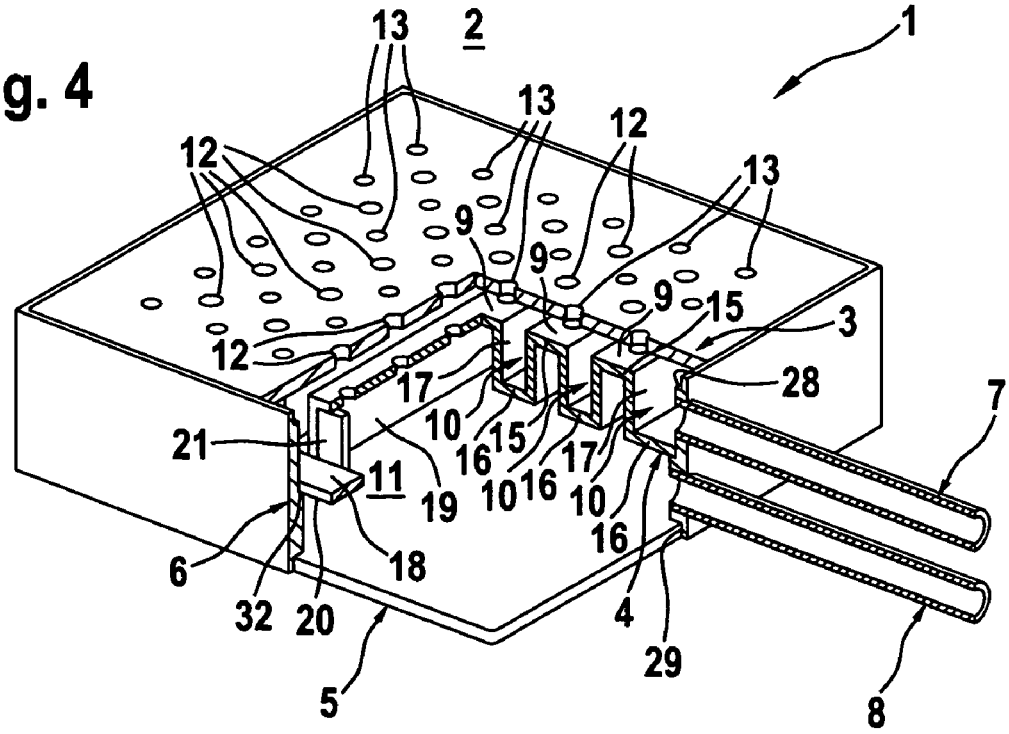
Figure 5:
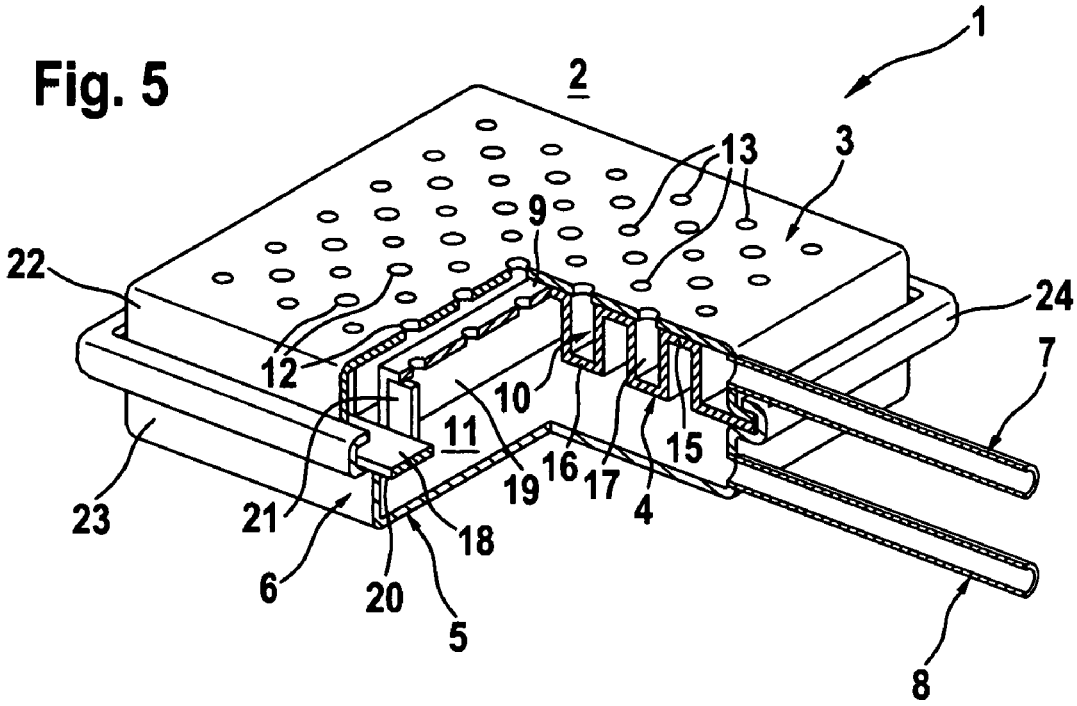
Figure 6:
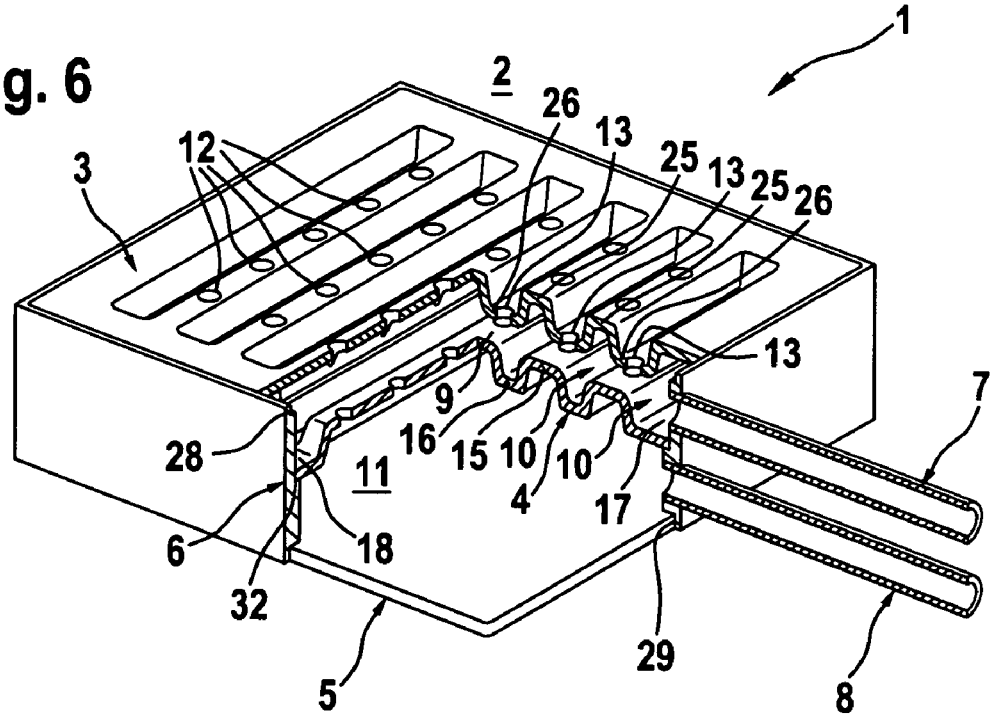
Figure 7:
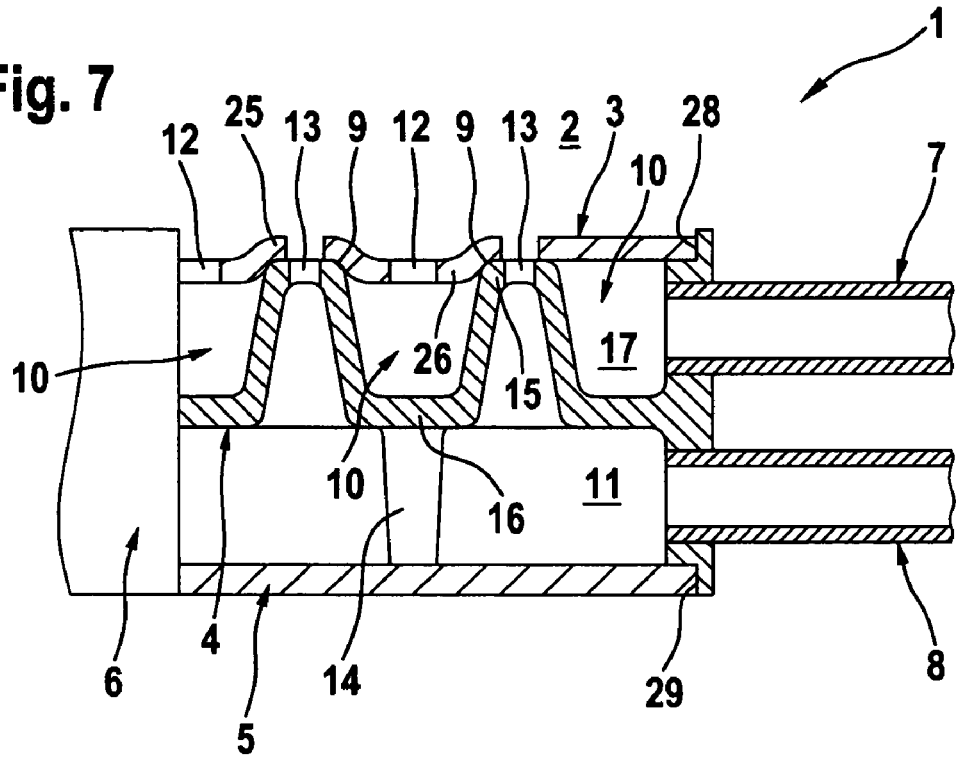
Figure 8:
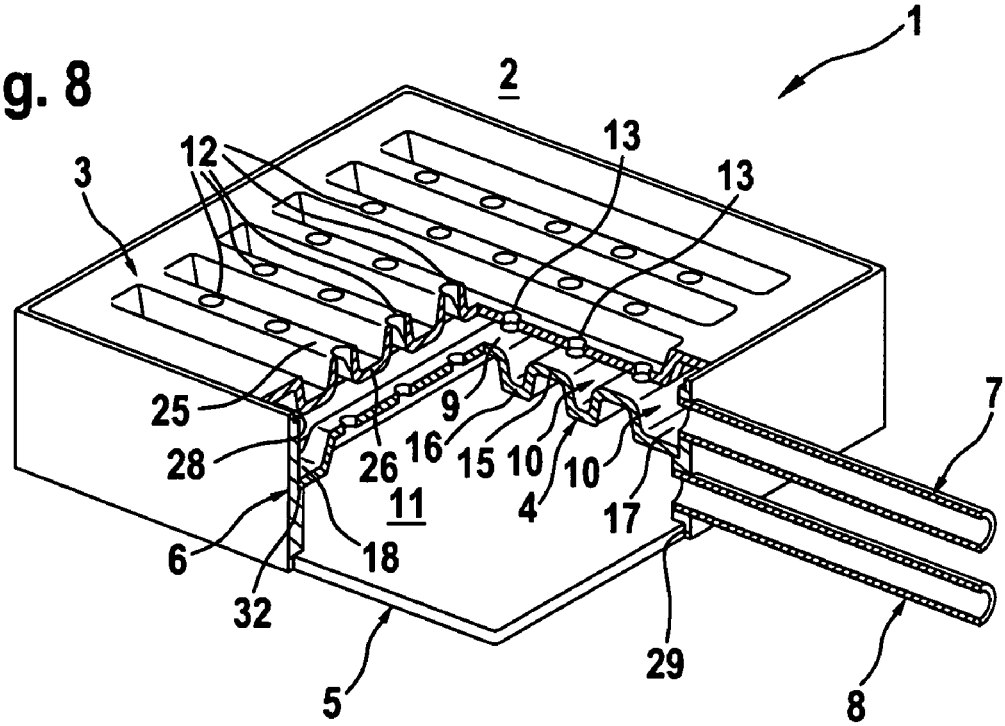
Figure 9:
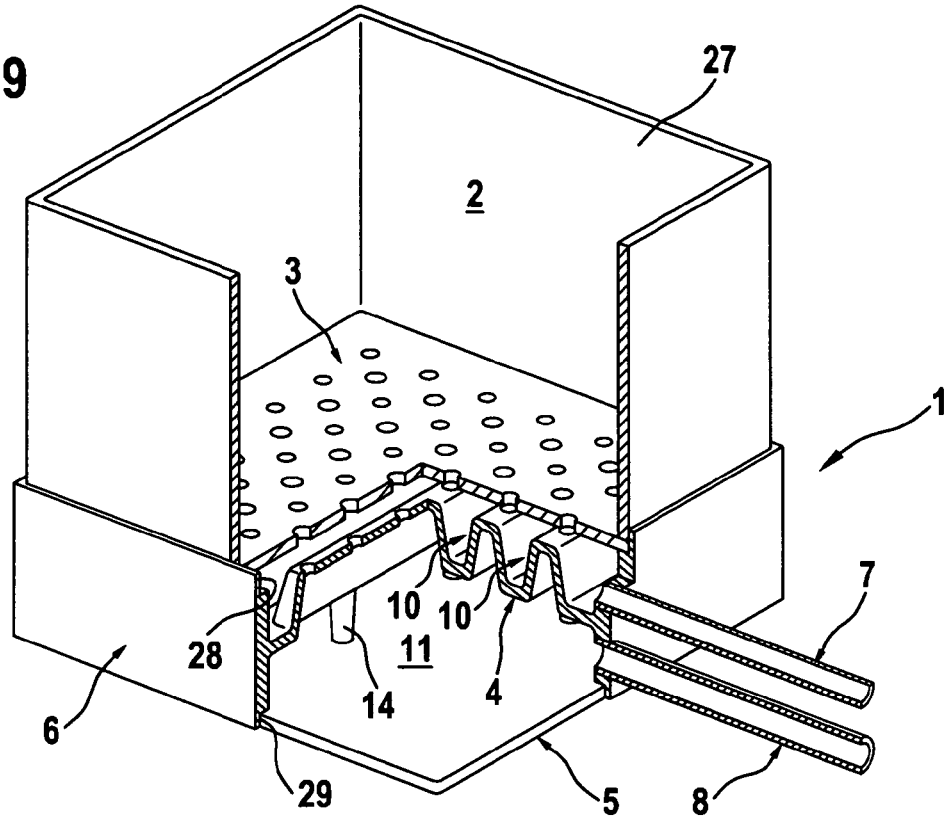
Figure 10:
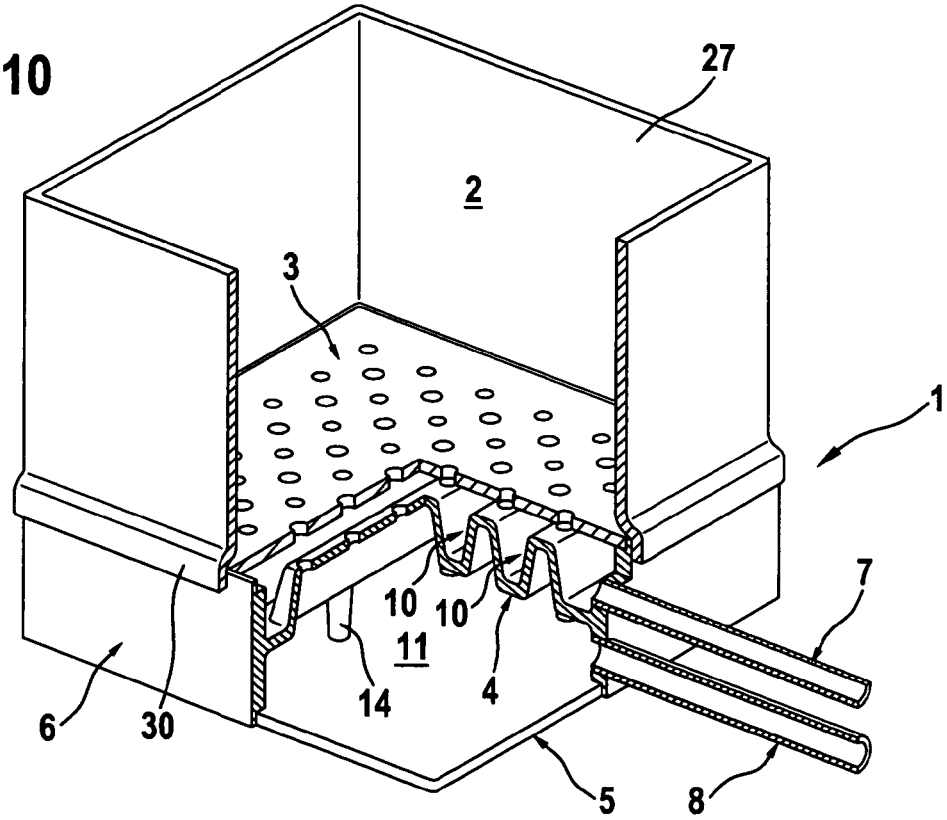

The figures show the following in schematic diagrams:

FIGS. 1 and 2 show partially sectional perspective views of a wall structure in various embodiments, FIG. 3 shows a perspective view of a bottom plate in a special embodiment, FIGS. 4 through 6 show partially sectional perspective views of a wall structure in various other embodiments, FIG. 7 shows a partially sectional side view of a wall structure in a different embodiment, FIGS. 8 through 10 show partially sectional perspective views of a wall structure in other embodiments.

DETAILED DESCRIPTION OF PREFERRED EMBODIMENTS OF THE INVENTION

FIG. 1 shows a wall structure 1 of a burner, which is not shown otherwise, in which the wall structure 1 serves to border a combustion chamber 2 of the burner. The wall structure 1 includes a top plate 3 and a bottom plate 4. In addition, the wall structure 1 also has a base plate 5, an enclosure 6 and, for example, two feed pipes, namely a first feed pipe 7 and a second feed pipe 8.

The top plate 3 is exposed to the combustion chamber 2. The bottom plate 4 is arranged on a side of the top plate 3 facing away from the combustion chamber 2 within the wall structure 1 in such a way that the bottom plate 4 is in contact with the top plate 3 in contact zones 9. The shaping of the top plate 3 and the bottom plate 4 is selected specifically so that a channel system 10 is formed between the top plate 3 and the bottom plate 4. In addition, the bottom plate 4 separates the channel system 10 from a feed space 11, which is designed on a side of the bottom plate 4 in the wall structure 1 facing away from the combustion chamber 2. In comparison with the bottom plate 4, said feed space 11 is bordered by the base plate 5. The enclosure 6 surrounds the top plate 3, the channel system 10, the bottom plate 4, the feed space 11 and the base plate 5 so that it is closed at the circumference.

For simplified airtight installation of the top plate 3 in the enclosure 6, the enclosure 6 is provided with an upper step 28 into which the top plate 3 can be inserted. Similarly, the enclosure 6 expediently also has a bottom step 29 into which the base plate 5 can be inserted.

The top plate 3 has first openings 12 which pass through the top plate 3 and communicate with the channel system 10. In the area of the contact zones 9, the top plate 3 and the bottom plate 4 together have second openings 13 which pass through the top plate 3 and the bottom plate 4 and communicate with the feed space 11.

The two feed pipes 7, 8 are each mounted on the enclosure and pass through it. The first feed pipe 7 communicates with the channel system 10 while the second feed pipe 8 communicates with the feed space 11. In this way a first gas path is formed in the wall structure 1, leading from the first feed pipe 7 through the channel system 10 and through the first openings 12 into the combustion chamber 2. A second gas path, which likewise leads from the second feed pipe 8 into the combustion chamber 2 through the feed space 11 and through the second openings 13, is separate from the former.

At least one supporting foot 14 by means of which the bottom plate 4 is supported on the base plate 5 may be provided for reinforcing the wall structure 1 in the feed space 11. This minimum of one supporting foot 14 may preferably be manufactured in one piece with the bottom plate 4. In addition, the particular supporting foot 14 may be soldered to the base plate 5.

The top plate 3 and the bottom plate 4 are joined in the area of the contact zones 9, e.g., by means of a first soldered joint. The feed pipes 7, 8 are also expediently attached to the enclosure 6, preferably by means of a second soldered joint.

The wall structure 1 is preferably manufactured as described below.

The top plate 3 is first provided with the first openings 12, e.g., by punching or drilling. Then the top plate 3 is permanently joined to the bottom plate 4, e.g., by the first soldered joint. Then the second openings 13 are produced, e.g., by punching or drilling. Only then are the base plate 5 and the feed pipes 7, 8 attached, e.g., via the second soldered joint. The second soldered joint has a lower solder temperature than the first soldered joint. This ensures that the first soldered joint produced previously, in particular between the top plate 3 and the bottom plate 4, will not be damaged when producing the second soldered joint.

The channel system 10 is created by the shaping of the top plate 3 and the bottom plate 4. To do so, the top plate 3 and/or the bottom plate 4 has/have a corrugated or rectangular structure.

In the embodiment illustrated in FIG. 1, only the bottom plate 4 has a corrugated or rectangular structure, while the top plate 3 essentially has a planar structure. The bottom plate 4 thus has hill structures 5 and valley structures 16 for definition of the channel system 10. Contact with the top plate 3 is established by means of the hill structures 15.

The channel system 10 includes several longitudinal channels 17 running parallel to one another and at least one, preferably two transverse channels 18, whereby the respective transverse channel 18 runs across the longitudinal channels 17.

The longitudinal channels 17 communicate with one another by way of the respective transverse channel 18. Two transverse channels 18 are preferably provided, these channels being arranged on the longitudinal ends of the longitudinal channels 17. In addition at least one other transverse channel 18 may also be provided, this one being arranged between the longitudinal ends of the longitudinal channels 17.

The longitudinal channel 17 into which the first feed pipe 17 opens is expediently designed as a pre-distribution space and has a larger volume than the other channels 17, 18.

In the embodiment illustrated in FIG. 1, the bottom plate 4 and the enclosure 6 are made of one piece. The bottom plate 4 and the enclosure 6 preferably form a one-piece cast part. In attaching the top plate 3 to the bottom plate 4, the top plate 3 is attached to the enclosure 6 at the same time.

In the embodiment according to FIG. 2, the bottom plate 4 and the enclosure 6 are separately manufactured components, whereby in particular the enclosure 6 is a cast part while the bottom plate 4 may essentially also be a deep-drawn part. The bottom plate 4 is expediently attached to the enclosure 6, e.g., by means of a soldered joint. To this end, the enclosure 6 may be equipped with a middle step 32 on which the separate bottom plate 4 rests and by means of which the bottom plate 4 is soldered to the enclosure 6.

In FIGS. 3 and 4 the bottom plate 4 is composed of multiple individual parts. The bottom plate 4 here includes a middle part 19 which has the corrugated or rectangular structure, and two side parts 20 connected to the middle part 19. The middle part 19 which has a corrugated or rectangular structure again has the valley structures 16 that are opened in the direction of the top plate 3 and the hill structures 15 that are open toward the feed space 15. The middle part 19 is produced by folding or deep drawing, for example. In the middle part 19 the hill structures 15 are open on their end faces due to the method of producing the middle part 19. The side parts 20 have several closures 21, each closing a hill structure 15 at the side. The closures 21 are bent at an angle from a channel bottom 31, which is also part of the side part 20. This channel bottom 31 borders one of the channels of the channel system 10, namely one of the transverse channels 18 to the feed space 11. FIG. 4 shows the wall structure 1 with the attached bottom plate 4 according to FIG. 3.

In the embodiment illustrated in FIG. 5, the enclosure 6 is made up of a top part 22 and a bottom part 23. The top part 22 faces the combustion chamber 2 while the bottom part 23 faces away from the combustion chamber 2. The two parts 22, 23 of the enclosure 6 are interconnected by a flange 24. In addition, soldered joint or a weld may be provided in the area of the flange 24. To form the flange 24, a collar of a part, namely the bottom part 23 here, is flanged over around a collar of the other part which protrudes outward, namely the top part 22 here. To secure the bottom plate 4 in the wall structure 1, it protrudes into the flange 24 and is also flanged. In the preferred embodiment illustrated here, the top plate 3 and the top part 22 are manufactured in one piece, e.g., by deep drawing. The bottom part 23 and the base plate 5 may also be manufactured in one piece, preferably by deep drawing.

In the embodiments illustrated in FIGS. 1 through 5, only the bottom plate 4 is provided with the corrugated or rectangular structure while the top plate 3 has a planar structure. It is also possible to have an embodiment in which only the top plate 3 is provided with a corrugated or rectangular structure while the bottom plate 4 has a planar structure.

According to FIGS. 6 through 8, both the bottom plate 4 and the top plate 3 may be provided with a corrugated structure. FIG. 6 shows an embodiment in which the hill structures 15 and the valley structures 16 of the bottom plate 4 run parallel to hill structures 25 and valley structures 26 of the top plate 3.

In the embodiment illustrated in FIG. 6, the top plate 3 and the bottom plate 4 are placed one on top of the other in such a way that the contact zones are arranged on the hill structures 5 of the bottom plate 4 and on the valley structures 26 of the top plate 3.

In contrast with that, FIG. 7 shows a variant in which the top plate 3 and the bottom plate 4 are placed one on top of the other so that the contact zones are again in contact with the hill structures 15 of the bottom plate 4 but on the other hand are also in contact with the hill structures 25 of the top plate 3. To implement this, the hill structures 25 and valley structures 26 of the top plate 3 are definitely designed to be weaker than those of the bottom plate 4. In this embodiment, in contrast with a top plate 3 having a planar structure, the contact surface, in which the top plate 3 and the bottom plate 4 are in contact with one another in the contact zones 9, may be increased in size, which improves the sealing of the contact zones 9.

In the embodiment illustrated in FIG. 8, the top plate 3 and the bottom plate 4 are arranged in relation to one another, so that the hill structures 25 and valley structures 26 of the top plate 3 are inclined with respect to the hill structures 15 and valley structures 16 of the bottom plate 4. In the example shown here, the hill and valley structures of the two plates 3, 4 run perpendicular to one another.

According to FIGS. 9 and 10, the combustion chamber 2 may be enclosed by a combustion chamber wall 27 at the sides. Expediently this combustion chamber wall 27 is attached to the wall structure 1. This combustion chamber wall 27 is preferably attached to the enclosure 6, e.g., by being soldered to it. According to FIG. 9, the combustion chamber wall 27 may be inserted into the enclosure 6 for this purpose. For example, the upper step 28 of the enclosure 6 may be lengthened accordingly for this purpose.

Alternatively, according to FIG. 10, the combustion chamber wall 27 may be placed on the enclosure 6. To do so, the combustion chamber wall 27 is provided with a correspondingly widened collar 30.

The embodiments of the top plate 3 and the bottom plate 4 illustrated in FIGS. 3 through 8 can also be combined at least partially with the integral design of the enclosure 6 and the bottom plate 4 according to FIG. 1 and with the additional embodiment according to FIGS. 9 and 10.

In a particular embodiment, the wall structure 1 may be attached directly to a fuel cell on the side facing away from the combustion chamber 2, preferably in such a way that an end plate or a closing plate of the fuel cell forms the base plate 5. Such an end plate or closing plate includes a gas outlet on the cathode end of the fuel cell. Accordingly, in this design, the oxygen-product gas mixture of the fuel cell on the cathode side can enter the feed space 11 directly. The second feed pipe 8 is then dispensable or may be used to supply cold air to the oxygenated gas in order to lower the combustion temperature in the combustion chamber 2.

In the embodiments illustrated in FIGS. 1 through 10, the two feed pipes 7, 8 are connected to the enclosure 6 at the sides. It is likewise possible for at least the second feed pipe 8 to be connected to the base plate 5 from beneath and thus to the feed space 11. It is likewise fundamentally possible for the first feed pipe 7 to be connected to the bottom plate 4 from the bottom through the base plate 5 and thus to the channel system 10.

The gas that contains the fuel is preferably supplied through the channel system 10 during operation of the burner equipped with the wall structure 1, while the gas that contains oxygen is supplied through the feed space 11. In the preferred application of the burner for burning the exhaust gases of a fuel cell, this is especially expedient because the oxygen-product gas mixture on the cathode end is available with a higher volume flow than the hydrogen-product gas mixture on the anode side.

To reduce the temperature in the combustion chamber 2, it is fundamentally possible to add a suitable cooling gas to one gas flow or the other. Cool air is preferably used as the cooling gas which is then mixed with the gas that contains oxygen. This may be accomplished, for example, through an additional cold air pipe (not shown here) which is preferably also connected to the feed space 11, e.g., via the enclosure 6 or via the base plate 5.

To distribute the gas supplied to the channel system 12, preferably the gas that contains the fuel, as uniformly as possible among the first openings 12, it may be expedient to design the individual channels 17, 18 of the channel system 10 to have different dimensions.

The invention claimed is:

1. A wall structure for bordering a combustion chamber of a burner, comprising:

a top plate having a top surface and a bottom surface, the combustion chamber arranged above the top surface, a bottom plate which is in contact with the top plate in contact zones on the bottom surface of the top plate, wherein the top plate and/or the bottom plate are shaped so as to form a plurality of channels between the top plate and the bottom plate, a first gas passage comprising first openings formed in the top plate providing communication between the plurality of channels and the combustion chamber, a second gas passage comprising two second openings formed in the top plate and the bottom plate in the contact zones providing communication between a feed space and the combustion chamber, wherein the first and second gas passages remain isolated until each passage communicates with the combustion chamber.

2. The wall structure according to claim 1, wherein:

the wall structure has an enclosure at a side which encloses the feed space and the plurality of channels at sides of the feed space and the plurality of channels, and the top plate is enclosed at its sides by the enclosure.

3. The wall structure according to claim 2, further comprising:

a base plate bordering the feed space on a side remote from the combustion chamber, the base plate being enclosed at a side thereof by the enclosure.

4. The wall structure according to claim 3, wherein:

the bottom plate is enclosed at a side thereof by the enclosure, and the bottom plate is supported on and/or attached to the base plate via at least one supporting foot.

5. The wall structure according to claim 3, further comprising:

a first feed pipe attached to the enclosure and communicating with the plurality of channels, and a second feed pipe attached to the enclosure and communicating with the feed space, wherein the second feed pipe is not in communication with the plurality of channels.

6. The wall structure according to claim 5, wherein:

the top plate is attached to at least one of the bottom plate and the enclosure with a first soldered joint, at least one of the feed pipes and the base plate are attached to the enclosure with a second soldered joint, wherein the second soldered joint has a lower soldering temperature than the first soldered joint.

7. The wall structure according to claim 2, wherein:

the enclosure comprises a top part facing the combustion chamber and a bottom part facing away from the combustion chamber.

8. The wall structure according to claim 7, wherein:

the top part and the bottom part are joined together at a flange, and the bottom plate protrudes into the flange.

9. The wall structure according to claim 1, wherein:

the plurality of channels has a plurality of longitudinal channels running parallel to one another and at least one transverse channel running across the longitudinal channels and communicating with one another via the longitudinal channels.

10. The wall structure according to claim 1, wherein one of the top plate and the bottom plate has a corrugated structure while the other plate has a planar structure.

11. The wall structure according to claim 1, wherein:

the bottom plate has a corrugated structure and has valley structures which are open toward the top plate and form channels in the channel system as well as hill structures that are open toward the feed space and have the contact zones, the hill structures are sealed by closures on at least one end face, the closures being bent at an angle from a side part, and the side part borders a channel of the channel system toward the feed space.

12. The wall structure according to claim 1, wherein:

the wall structure has an enclosure at a side which encloses the feed space and the plurality of channels at sides of the feed space and the plurality of channels, and the bottom plate and the enclosure are a one-piece cast part.

13. The wall structure according to claim 1, wherein:

the top plate and the bottom plate each have a corrugated structure and each have hill structures and valley structures, and the top plate and the bottom plate are arranged in relation to one another so that the hill structures and the valley structures of the top plate and the bottom plate run parallel to one another.

14. The wall structure according to claim 1, wherein:

the top plate and the bottom plate each have a corrugated structure and each have hill structures and valley structures, and the top plate and the bottom plate are arranged in relation to one another so that the hill structures and the valley structures of the top plate are inclined or run perpendicular to the hill structures and the valley structures of the bottom plate.

15. The wall structure according to claim 1, wherein:

the top plate and the bottom plate each have a corrugated structure and each have hill structures and valley structures, and the contact zones are arranged on the hill structures of the bottom plate and on the valley structures of the top plate.

16. The wall structure according to claim 1, wherein: the top plate and the bottom plate each have a corrugated structure and each have hill structures and valley structures, and the hill structures and the valley structures of the bottom plate are more pronounced than the hill structures and the valley structures of the top plate.

17. The wall structure according to claim 1, wherein: the combustion chamber is enclosed at its sides by a combustion chamber wall which is attached to the wall structure.

18. The wall structure according to claim 1, wherein:

the wall structure has an enclosure at a side which encloses the feed space and the channel system at sides of the feed space and the channel system, and the combustion chamber is enclosed at its sides by a combustion chamber wall which is within the enclosure.

19. The wall structure according to claim 1, wherein:

the wall structure has an enclosure at a side which encloses the feed space and the plurality of channels at sides of the feed space and the plurality of channels, and the combustion chamber is enclosed at its sides by a combustion chamber wall which is on top of the enclosure.

20. The wall structure according to claim 1, wherein a first gas is supplied to the plurality of channels and a second gas is supplied to the feed space, wherein the gas supplied to the feed space is not supplied to the plurality of channels, and wherein a burning of a gaseous mixture comprising the first and second gas takes place in the combustion chamber.

21. The wall structure according to claim 1, wherein gas supplied to the first and second passages remains isolated until it passes through the first and second openings in the top plate.

22. The wall structure according to claim 1, wherein the feed space is arranged below the bottom plate, on a side facing away from the combustion chamber.

* * * * *